US009656486B2

(12) United States Patent
Kanda

(10) Patent No.: US 9,656,486 B2
(45) Date of Patent: May 23, 2017

(54) PRINTER AND PRINTING SYSTEM

(71) Applicant: Brother Kogyo Kabushiki Kaisha, Nagoya-shi, Aichi-ken (JP)

(72) Inventor: Mitsuhiro Kanda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/223,058

(22) Filed: Jul. 29, 2016

(65) Prior Publication Data

US 2017/0028747 A1 Feb. 2, 2017

(30) Foreign Application Priority Data

Jul. 31, 2015 (JP) ..... 2015-152875

(51) Int. Cl.
*B41J 11/66* (2006.01)
*B41J 3/407* (2006.01)
*B41J 29/38* (2006.01)

(52) U.S. Cl.
CPC ..... *B41J 11/663* (2013.01); *B41J 3/4075* (2013.01); *B41J 29/38* (2013.01)

(58) Field of Classification Search
CPC . B41J 3/4075; B41J 11/42; B41J 11/44; B41J 11/46; B41J 11/663; B41J 29/38
See application file for complete search history.

(56) References Cited

U.S. PATENT DOCUMENTS 5,041,850 A * 8/1991 Kahoyashi ..... B41J 11/703 347/157
5,430,468 A * 7/1995 Sasai ..... B41J 17/36 346/136
5,528,237 A * 6/1996 Moloney ..... H03M 5/145 341/59
8,967,890 B2 * 3/2015 Hoshino ..... B41J 11/70 271/279
9,352,597 B2 * 5/2016 Sakaino ..... G07F 19/201
9,393,815 B2 7/2016 Kanda et al.
2014/0227017 A1 8/2014 Kanda et al.

FOREIGN PATENT DOCUMENTS

JP 2010-030188 A 2/2010
JP 2014-156029 A 8/2014

* cited by examiner

*Primary Examiner* — Anh T. N. Vo
(74) *Attorney, Agent, or Firm* — Banner & Witcoff, Ltd.

(57) ABSTRACT

The disclosure discloses a printer including a controller configured to execute a setting process, a transport stop process, and a first transport control process. In the transport stop process, a driving device is controlled to stop transport of a print-receiving medium in a state in which an intermediate position faces a cutter. The intermediate position is between a print part last in order and a print-receiving part located immediately after the print part last in order. In the first transport control process, the driving device is control to transport the print-receiving medium to an upstream side by a first unit transport amount in accordance with an operation of a first operation device or to transport the print-receiving medium to a downstream side by a second unit transport amount in accordance with an operation of a second operation device.

9 Claims, 12 Drawing Sheets

SET VALUE FOR B: 3.0 mm
7E
7B
7E
7B
7E
L
7E
L
A B C
A B C
7
8
8A
7A
TAPE TRANSPORT DIRECTION
4D
4E
CALCULATE B → 3.5mm
CALCULATE DIFFERENCE AMOUNT OF B → 0.5mm
CALCULATE FIRST AND
SECOND UNIT TRANSPORT AMOUNTS → 0.1mm

PRINTER AND PRINTING SYSTEM

CROSS-REFERENCE TO RELATED APPLICATION

The present application claims priority from Japanese Patent Application No. 2015-152875, which was filed on Jul. 31, 2015, the disclosure of which is incorporated herein by reference in its entirety.

BACKGROUND

Field

The present disclosure relates to a printer and a printing system performing printing on a print-receiving medium.

Description of the Related Art

A printer performing printing on a print-receiving medium is conventionally known. In this prior art printer (label producing device), a print-receiving medium (print-receiving tape) fed out from a print-receiving medium roll (roll) stored in a roll storage part is transported by a feeder (platen roller), and a desired print is formed by a printing head (printing head) on a print-receiving part of the transported print-receiving medium so as to create a print part. The print-receiving medium after print formation is cut by using a cutter (cutting blade) disposed downstream of the printing head.

In the prior art, an element to be detected (black mark) of the transported print-receiving medium is detected by a detecting device (sensor main body). Based on a detection result of the detecting device and an initially-set medium information including an arrangement form of the element to be detected (e.g., a length of the element to be detected along the transport direction) etc. on the print-receiving medium, the transport of the print-receiving medium is controlled to be stopped in a state (hereinafter referred to as a proper state) in which a predetermined intermediate position between the print part last in order along the transport direction and the print-receiving part located immediately before the print part last in order along the transport direction faces the cutter.

However, in the case of using a so-called third-party print-receiving medium roll, even if the transport of the print-receiving medium is controlled to be stopped in the proper state, the detecting device may erroneously detect the position etc., of the element to be detected due to a difference in thickness, material quality, surface treatment, etc. of the print-receiving medium from a so-called genuine print-receiving medium roll, and the transport of the print-receiving medium may not be stopped in the proper state. In such a case, if an operator can easily and intuitively correct the transport stop position of the print-receiving medium on the spot, this is extremely convenient since the operability can be improved. However, no particular consideration is given to such a point in the prior art.

SUMMARY

It is an object of the present disclosure to provide a printer and a printing system enabling an operator to easily and intuitively correct the transport stop position of the print-receiving medium on the spot if the transport of the print-receiving medium is not stopped in the proper state so that the operability can be improved.

In order to achieve the above-described object, according to an aspect of the present application, there is provided a printer comprising a roll storage part configured to store a print-receiving medium roll having a print-receiving medium wound therearound, the print-receiving medium including a plurality of print-receiving parts and an element to be detected for identifying the print-receiving parts, a feeder configured to transport the print-receiving medium fed out from the print-receiving medium roll stored in the roll storage part, a driving device configured to drive the feeder, a printing head configured to sequentially form a desired print on the plurality of print-receiving parts of the print-receiving medium transported by the feeder so as to create a plurality of print parts, a cutter that is configured to cut the print-receiving medium, and is disposed downstream side of the printing head along a transport direction of the feeder, a detecting device configured to detect the element to be detected, and a controller, the controller being configured to execute a setting process for setting medium information based on input information for initial setting, the medium information at least including an arrangement form of the element to be detected on the print-receiving medium, and a transport stop process for controlling the driving device based on a detection result of the detecting device and a setting result of the setting process to stop transport of the print-receiving medium in a state in which a predetermined intermediate position faces the cutter, the predetermined intermediate position being between the print part last in order along the transport direction and the print-receiving part located immediately after the print part last in order along the transport direction, the printer further comprising a first operation device configured to perform operation of transporting the print-receiving medium along the transport direction to an upstream side by a first unit transport amount so as to correct a transport stop position of the print-receiving medium after the transport of the print-receiving medium is stopped by control of the transport stop process, and a second operation device configured to perform operation of transporting the print-receiving medium to the downstream side by a second unit transport amount so as to correct the transport stop position of the print-receiving medium after the transport of the print-receiving medium is stopped by control of the transport stop process, the controller being configured to further execute a first transport control process for controlling the driving device to transport the print-receiving medium to the upstream side by the first unit transport amount in accordance with an operation of the first operation device or to transport the print-receiving medium to the downstream side by the second unit transport amount in accordance with an operation of the second operation device.

DETAILED DESCRIPTION OF THE PREFERRED EMBODIMENTS

An embodiment of the present disclosure will now be described with reference to the drawings.

<External Appearance Schematic Configuration>

Figure 1:
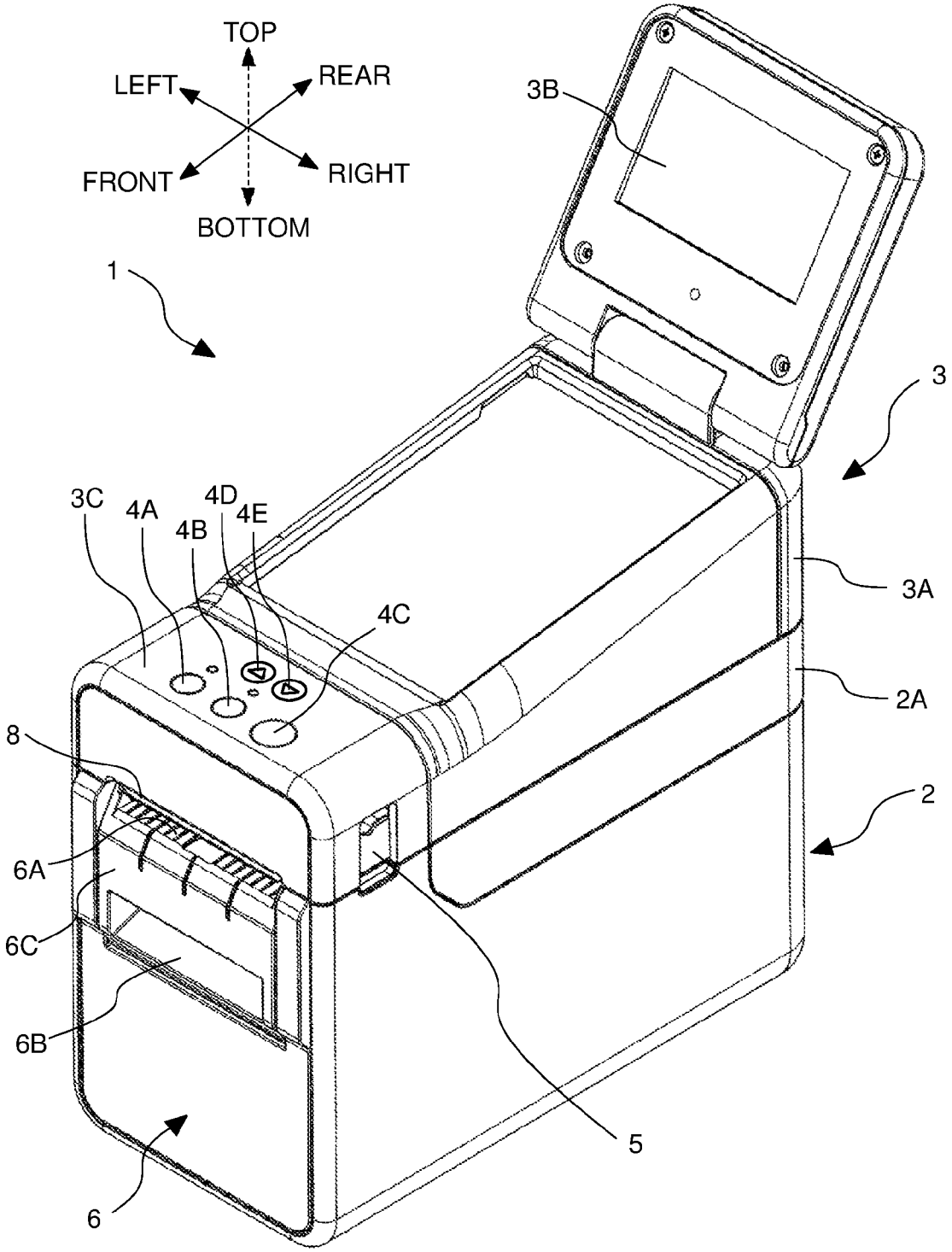
FIG. 1 is a perspective view showing an exterior appearance of a label producing device of an embodiment of the present disclosure.

Referring to FIG. 1, an external appearance schematic configuration of a label producing device of this embodiment will be described. In the following description, a front/rear direction, a left/right direction, and a top/bottom direction refer to the directions of arrows appropriately shown in FIG. 1, etc.

As shown in FIG. 1, a label producing device 1 (equivalent to a printer) has a housing 2 with a front panel 6, and a top cover unit 3. These housing 2 and top cover unit 3 are made of resin for example. The top cover unit 3 includes a touch panel part 3A, a substantially rectangular liquid crystal panel part 3B and an operation button part 3C.

The top cover unit 3 is connected at its rear end to the housing 2 pivotally via a pivot 2*a* (see FIG. 3 described later) so that the top cover unit 3 can be opened or closed with respect to the housing 2. A housing cover part 2A partially making up the housing 2 is disposed integrally under the top cover unit 3 so that when the top cover unit 3 is opened or closed, the housing cover part 2A also opens or closes together therewith (see FIG. 2 described later).

The liquid crystal panel part 3B is connected at its rear end to the touch panel part 3A pivotally via a pivot 3*a* (see FIG. 3 described later) so that the liquid crystal panel part 3B can be opened or closed with respect to the touch panel part 3A.

The operation button part 3C is disposed on the top cover unit 3 at its frontward top surface position and includes a power button 4A of the label producing device 1, a status button 4B for displaying the operation status of peripheral equipment, a feed button 4C, an up button 4D (equivalent to a first operating device), and a down button 4E (equivalent to a second operating device) that are arranged thereon.

The housing 2 has release knobs 5 disposed on both left and right side walls thereof (FIG. 1 shows only the release knob 5 disposed on the right side wall). By pushing up these release knobs 5, the top cover unit 3 is disengaged from the housing 2 so that the top cover unit 3 can be released therefrom.

The front panel 6 includes a first discharging exit 6A and a second discharging exit 6B positioned below the first discharging exit 6A. Around a portion having the second discharging exit 6B, the front panel 6 includes an opening/closing lid 6C that is pivotable frontward for facilitating e.g. installation of a print-receiving tape 7 described later or ejection of paper.

The first discharging exit 6A is defined by a front upper edge of the housing 2 and a front lower edge of the top cover unit 3 when the top cover unit 3 is closed. The top cover unit 3 has a downward directed cutting blade 8 (equivalent to a cutter) along an inner lower edge toward the first discharging exit 6A (see also FIGS. 2 to 4 described later).

<Internal Structure>

An internal structure of the label producing device 1 will then be described with reference to FIGS. 2 to 4.

Figure 2:
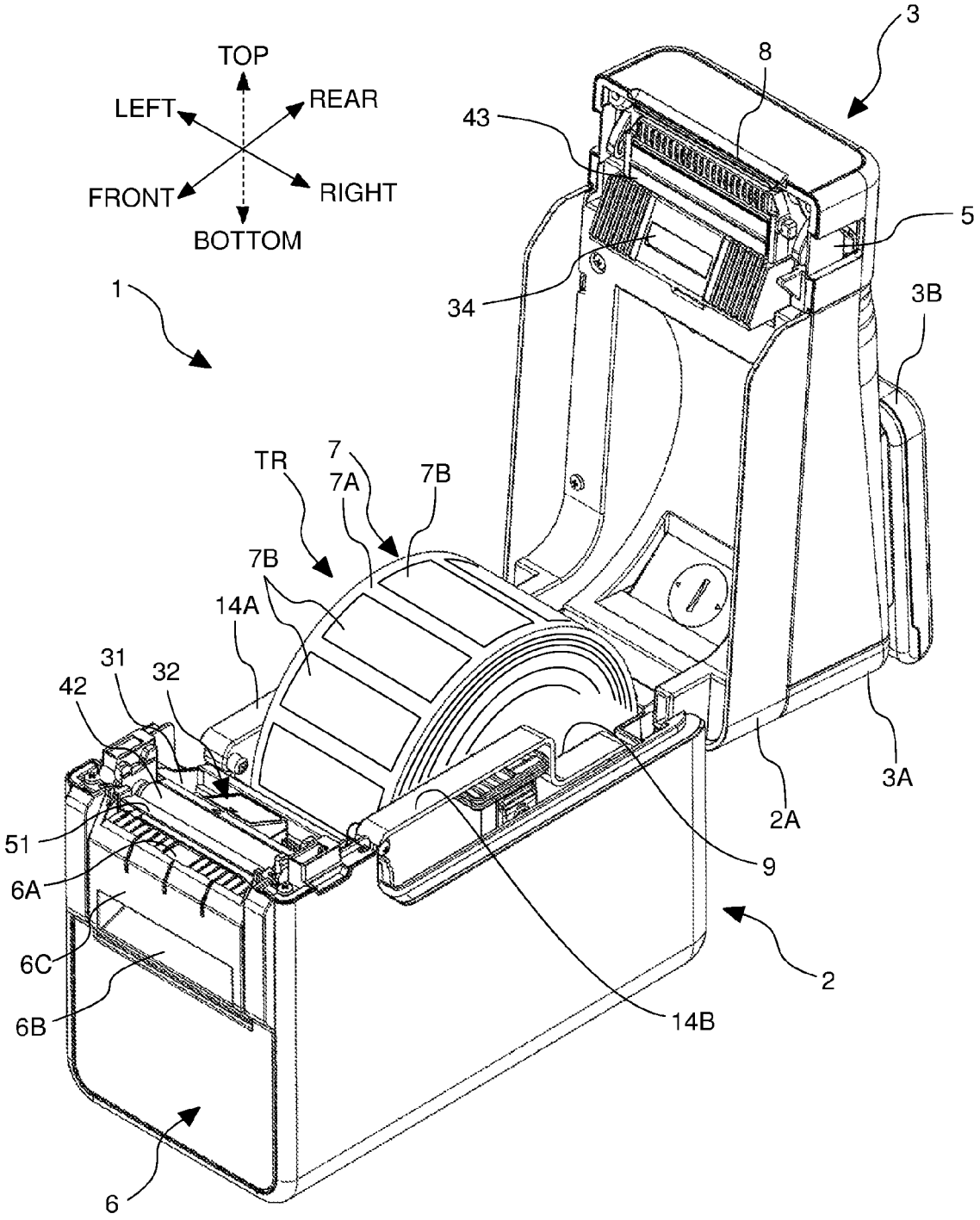
FIG. 2 is a perspective view showing the label producing device with an upper cover unit opened.
Figure 3:
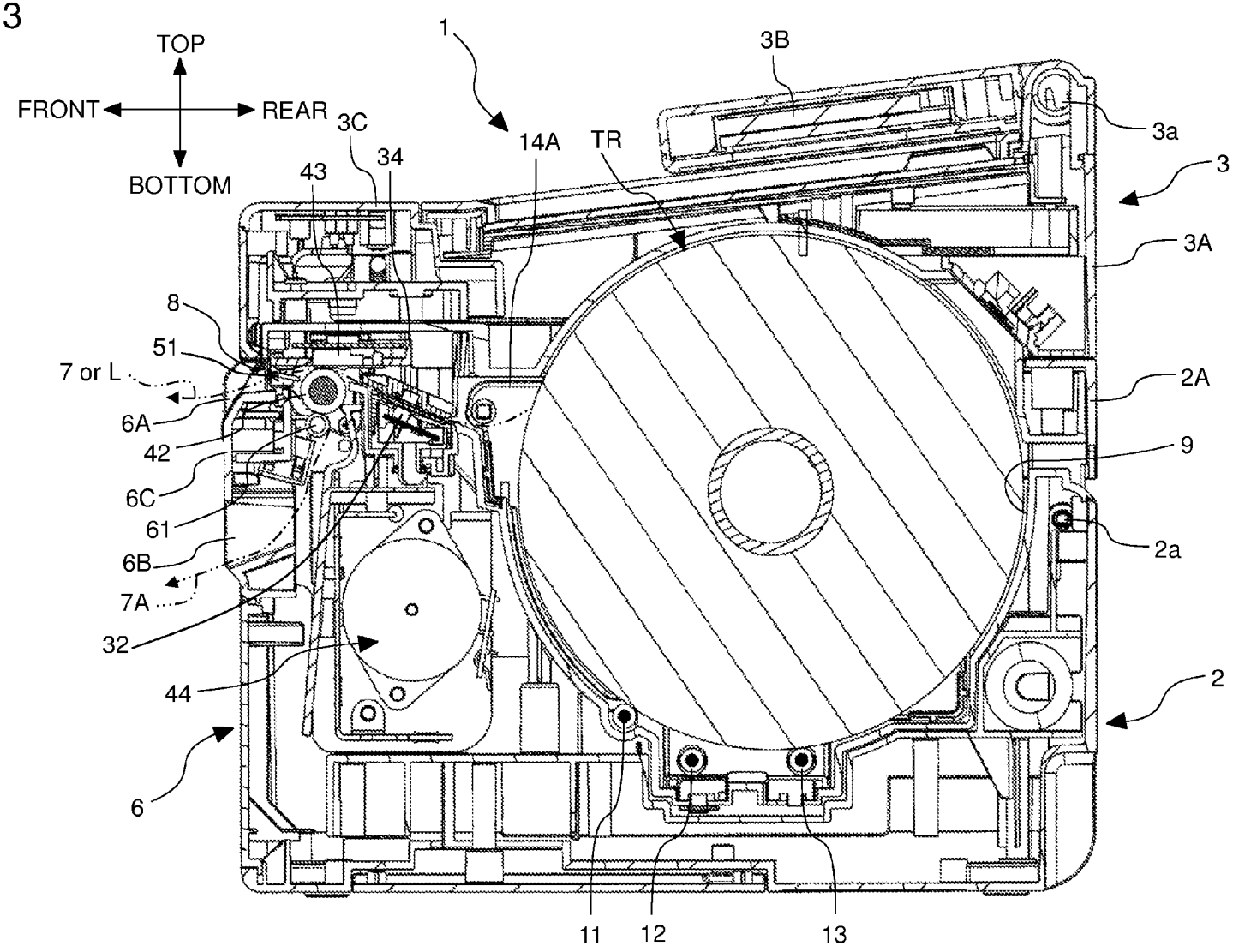
FIG. 3 is a side cross-sectional view showing a general structure of the label producing device.
Figure 4:
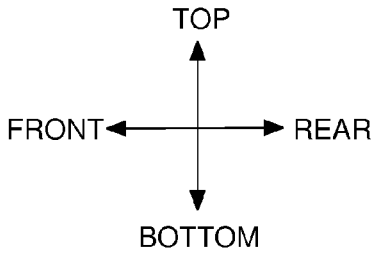
FIG. 4 is a side cross-sectional view showing a main structure of the label producing device.
Figure 4:
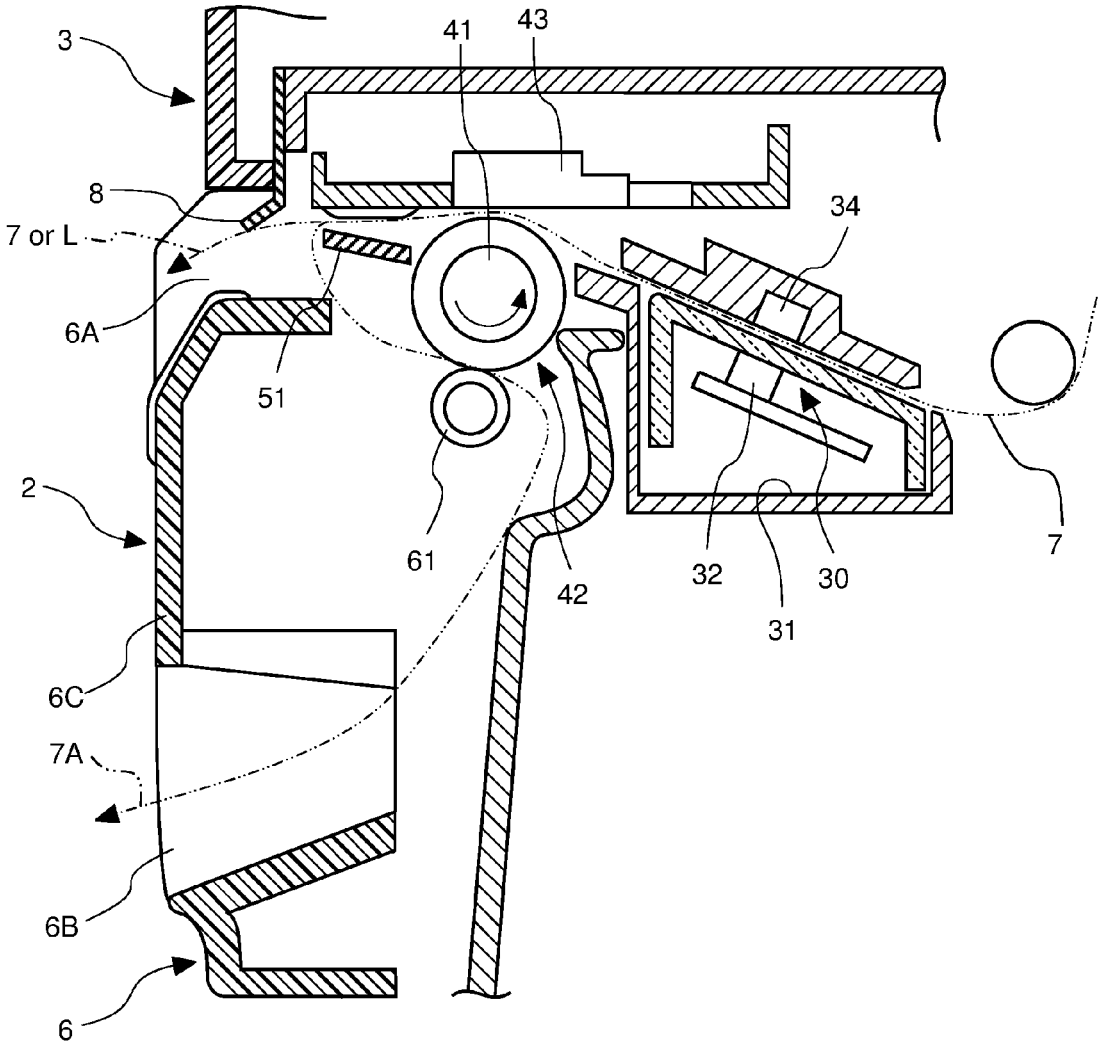

As shown in FIGS. 2 to 4, the label producing device 1 has a recessed roll storage part 9 in a rearward internal space of the housing 2. The roll storage part 9 stores a roll TR (equivalent to a print-receiving medium roll) into which a print-receiving tape 7 (equivalent to a print-receiving medium) with a desired width is wound such that the print-receiving tape 7 is fed out from the upper side of the roll.

The roll TR is rotatably stored in the roll storage part 9, with a winding axis of the print-receiving tape 7 extending along the left-right direction orthogonal to the front-rear direction.

<Print-Receiving Tape>

Figure 5A:
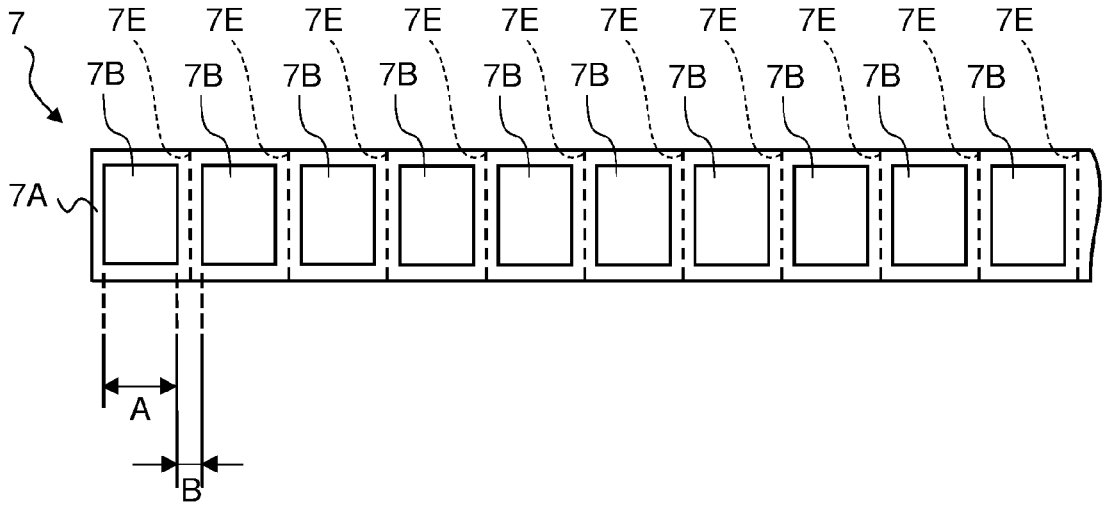
FIG. 5A is a plane view of a print-receiving tape for explaining a structure of the print-receiving tape.
Figure 5B:
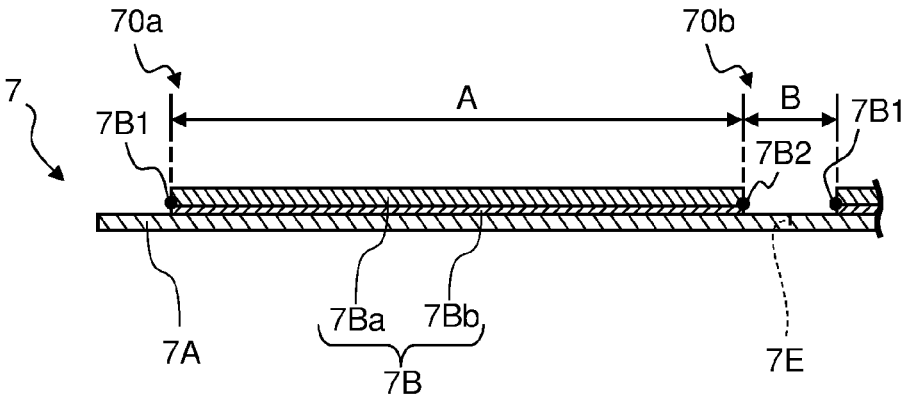
FIG. 5B is a longitudinal sectional view of the print-receiving tape for explaining the structure of the print-receiving tape.

As shown in FIGS. 2, 5A and 5B, label boards 7B used as price tags for example are longitudinally discretely continuously arranged via a separation material 7A on the print-receiving tape 7 forming the roll TR. More specifically, the label boards 7B in this example are of a two-layer structure where a print-receiving portion 7Ba having print formed by a printing head 43 described later and an adhesive 7Bb are laminated in the mentioned order. The label boards 7B are adhered at predetermined intervals to a surface on one side of the separation material 7A by an adhesive force of the adhesive 7Bb. That is, the print-receiving tape 7 has a three-layer structure of the print-receiving portion 7Ba, the adhesive 7Bb, and the separation material 7A at portions to which the label boards 7B are adhered (hereinafter, referred to appropriately as "label mount parts") 70*a* and has a one-layer structure of only the separation material 7A at portions to which no label boards 7B are adhered (i.e. portions between adjacent label boards 7B; hereinafter, referred to appropriately as "inter-label-mount parts) 70*b*. The inter-label-mount parts 70*b* are equivalent to elements to be detected of claims. The label boards having print formed thereon are finally separated from the separation material 7A to be adhered as print labels (see FIGS. 7A, 7B, etc. described later) to a predetermined adhesion target such as an article. Perforations may be disposed on the separation material 7A at center positions 7E of the inter-label-mount parts 70*b*.

<Support Roller>

As shown in FIGS. 2 to 4, three support rollers 11 to 13 are disposed on a bottom portion of the roll storage portion 9. When a platen roller 42 described later is rotationally driven to pull out the print-receiving tape 7 from the roll TR, at least two of the support rollers 11 to 13 come into contact with the outer peripheral surface of the roll TR so that they rotate in a following manner to rotatably support the roll TR. These support rollers 11 to 13 have different circumferential positions with respect to the roll TR and are arranged from front toward rear along the circumferential direction of the roll TR, in the order of the first support roller 11, the second support roller 12, and the third support roller 13. These support rollers 11 to 13 are each divided into a plurality of portions in the left-right direction (in other words, roll width direction) so that only the portions mounted with the roll TR rotate in accordance with the roll width.

<Guide Member>

The roll storage part 9 includes a first guide member 14A coming into contact with a right end face of the roll TR to guide the print-receiving tape 7 in the left-right direction (i.e. tape width direction) and a second guide member 14B coming into contact with a left end face of the roll TR to guide the print-receiving tape 7 in the left-right direction. These guide members 14A and 14B advance or retreat along the left-right direction so that they can come closer to or move away from each other. The first guide member 14A comes into contact with the roll TR from right side and the second guide member 14B comes into contact therewith from left side so as to guide the print-receiving tape 7 while sandwiching the roll TR from both sides. Since the guide members 14A and 14B are disposed advanceable and retreatable along the left-right direction in this manner, the roll TR of any width can be sandwiched by the guide members 14A and 14B so that the width direction of the print-receiving tape 7 can be guided, by allowing the guide members 14A and 14B to advance or retreat in accordance with the width of the stored roll TR to adjust the positions thereof.

<Platen Roller, Printing Head, and Peripheral Structure Thereof>

The printing head 43 is disposed on a lower side at the front end of the top cover unit 3. The platen roller 42 (equivalent to a feeder) is disposed on an upper side at the front end of the housing 2 in such a manner as to face the printing head 43 in the top-bottom direction. A roller shaft 41 of the platen roller 42 is rotatably supported by a bracket disposed axially on both ends, with a gear (not shown) driving the platen roller 42 being fixed to a shaft end on one hand of the roller shaft 41.

At this time, the arrangement position of the platen roller 42 in the housing 2 corresponds to the attachment position of the printing head 43 in the top cover unit 3. The roll TR stored in the roller storage part 9 by the operator is set in the roller storage part 9 to the state where the print-receiving tape 7 is pinched by hand and pulled out from the roll TR in the direction of transport of the print-receiving tape 7 (hereinafter, referred to appropriately as "tape transport direction") by the platen roller 42. By closing the top cover unit 3, the print-receiving tape 7 is clamped by the printing head 43 disposed on the top cover unit 3 and the platen roller 42 disposed on the housing 2, rendering the print by the printing head 43 feasible. By closing the top cover unit 3, the above-described gear fixed to the roller shaft 41 of the platen roller 42 meshes with a gear train not shown of the housing 2 so that the platen roller 42 is rotationally driven by the platen roller 42 by a transport motor 44 (equivalent to a driving device) that is a stepping motor. Thereby, the platen roller 42 feeds out the print-receiving tape 7 from the roll TR to transport the print-receiving tape 7 with a posture where its tape width direction is the left-right direction.

The printing head 43 is at its intermediate portion supported and downward urged by a proper spring member (not shown). By opening the top cover unit 3 by the release knob 5, the printing head 43 becomes apart from the platen roller 42. On the other hand, by closing the top cover unit 3, the urging force of the above-described spring member presses and urges the print-receiving tape 7 against and toward the platen roller 42, rendering the printing feasible.

In this example, the above-described roll TR is in the form of a roll into which the print-receiving tape 7 is wound such that the label boards 7B are on the radially outside. As a result, the print-receiving tape 7 is fed out from the top side of the roll TR with the surfaces on the label boards 7B being directed upward (see two-dot chain line in FIG. 3) so that print is formed on the print-receiving portions 7Ba of the label boards 7B by the printing head 43 disposed above the print-receiving tape 7. As a result, already-printed print-receiving portions 7Ba as print portions 7Ba' are formed (see FIGS. 7A and 7B described later).

A separation plate 51 is disposed frontward of the platen roller 42, the separation plate serving to fold back the print-receiving tape 7 downward of the platen roller 42 when the print-receiving tape 7 is transported in a separation transport mode described later, to thereby separate the above-described print label L having the above-described print portion 7Ba' and adhesive 7Bb from the separation material 7A. The print label L separated from the separation material 7A by the separation plate 51 is discharged via the first discharging exit 6A positioned further frontward of the separation plate 51 to the outside of the housing 2.

The cutting blade 8 is disposed downstream of the printing head 43 along the tape transport direction and is used to cut the print-receiving tape 7 at a desired position by the operator. When the print-receiving tape 7 is transported in a normal transport mode described later, the print-receiving tape 7 is discharged via the above-described first discharging exit 6A to the outside of the housing 2, with the above-described print label L and the separation material 7A being united together, without being subjected to separation at the separation plate 51.

A pinch roller 61 is disposed below the platen roller 42, the pinch roller 61 rotating following the rotation of the platen roller 42. The pinch roller 61 pinches the separation material 7A folded back downward by the above-described separation plate 51 between the pinch roller 61 and the platen roller 42, for transport. The separation material 7A transported by the pinch roller 61 is discharged from the above-described second discharging exit 6B to the outside of the housing 2. This pinch roller 61 is disposed on the opening/closing lid 6C via a proper support member (not shown).

<Sensor>

A sensor placement part 31 in the form of a recessed mounting surface is disposed on a transport path of the print-receiving tape 7 (hereinafter, referred to appropriately as "tape transport path") frontward of the roll storage part 9. A light-emitting part 32 of a sensor 30 (equivalent to a detecting device; see FIG. 4) for optically detecting a predetermined reference position of the print-receiving tape 7 is disposed on the sensor placement part 31. Allowing for the case of using plural types of print-receiving tapes 7 with various widths, the light-emitting part 32 is arranged on the sensor placement part 31 movably along the width direction (i.e. left-right direction) of the print-receiving tape 7 orthogonal to the tape transport direction. The sensor 30 is a known transmission-type optical sensor having the above-described light-emitting part 32 and a light-receiving part 34 disposed on the undersurface of the top cover unit 3. The light-emitting part 32 and the light-receiving part 34 face each other across the tape transport path when the top surface of the housing 2 is covered by the top cover unit 3. The sensor 30 receives by the light-receiving part 34 transmission light that is light from the light-emitting part 32 passing through the print-receiving tape 7, to detect end positions 7B1 and 7B2 (see FIG. 5B) of the label boards 7B in the tape transport direction, as the reference positions, based on a difference of light reception amount at this time arising from the difference in thickness for example of the above-described label mount part 70*a* and the above-described inter-label-mount part 70*b*. As a result of the detection of the end position 7B2 of the preceding label board 7B and the detection of the end position 7B1 of the succeeding label board 7B, the inter-label-mount part 70*b* between the two label boards 7B is also detected as the reference position.

<Control System>

Figure 6:
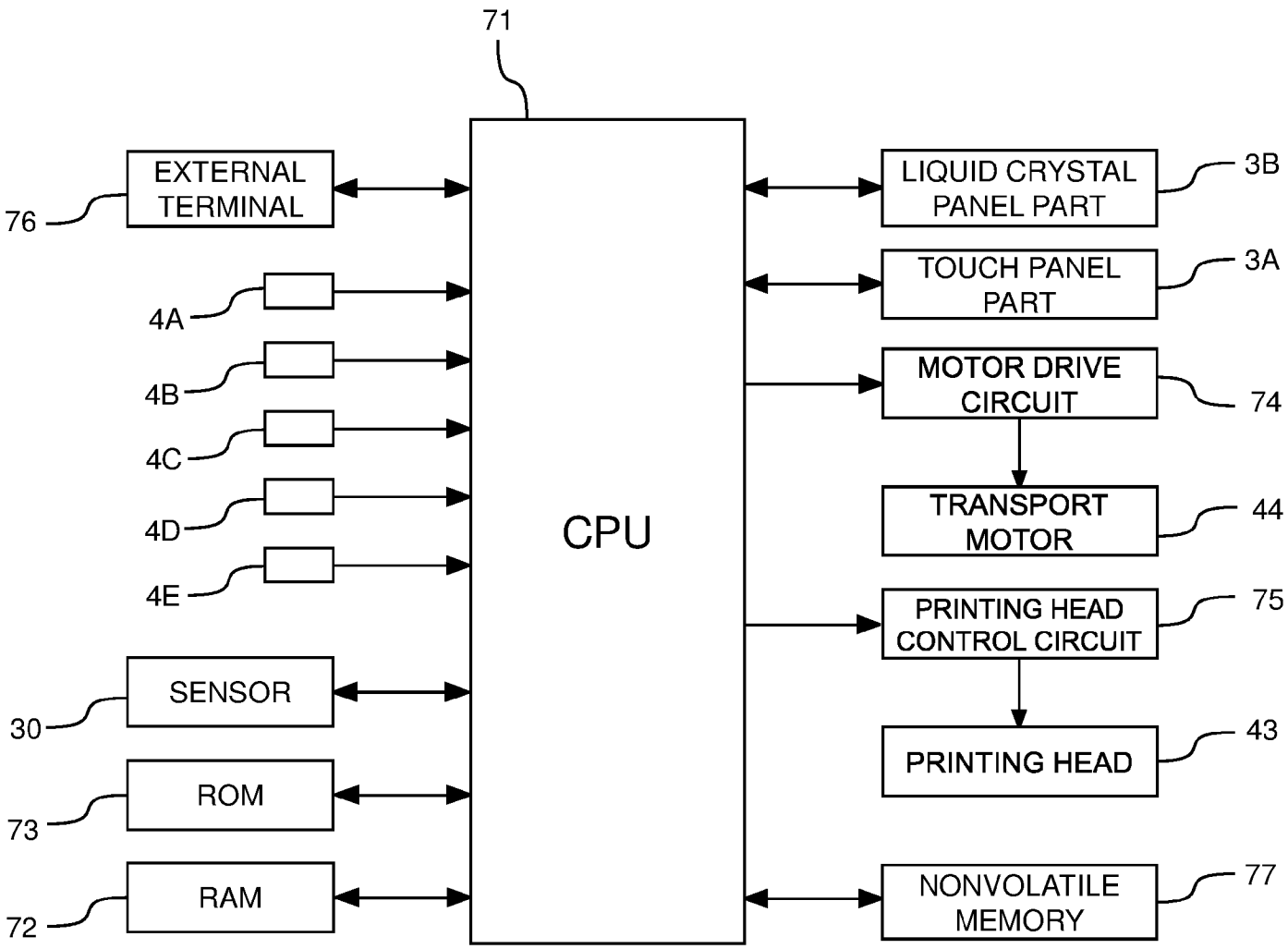
FIG. 6 is a block diagram showing a control system of the label producing device.

Referring then to FIG. 6, a control system of the label producing device 1 will be described.

As shown in FIG. 6, the label producing device 1 includes a calculating part performing a predetermined calculation and a CPU 71 acting as a controller. The CPU 71 performs signal processing in accordance with a program previously stored in a ROM 73 while utilizing the temporary storage function of a RAM 72, to thereby perform control of the entire label producing device 1. The CPU 71 is connected, for example, to the above-described liquid crystal panel part 3B, the above-described touch panel part 3A, the above-described RAM 72, the above-described ROM 73, the above-described sensor 30, the above-described power button 4A, the above-described status button 4B, the above-described feed button 4C, the above-described up button 4D, the above-described down button 4*e*, a nonvolatile memory 77 (equivalent to memory), a motor drive circuit 74 performing drive control of the above-described transport motor 44 driving the above-described platen roller 42, and a printing head control circuit 75 performing energization control of the heat-generating element of the above-described printing head 43.

The CPU 71 is connected by wire or wireless to an external terminal 76 such as a personal computer (PC) in such a manner as to be capable of receiving/transmitting information. The CPU 71 receives and inputs, from the external terminal 76, a print command including desired print data and the number of print labels L to be produced, produced and designated by the operator operating the external terminal 76. The print command may be generated and designated based on the operation of the touch panel part 3A. The CPU 71 receives and inputs, from the external terminal 76, input information for initialization input by the operator operating the external terminal 76 at the time of replacement of the roll TR for example. The input information for initialization contains, as the arrangement mode of the inter-label-mount parts 70*b* on the print-receiving tape 7, a length A (see FIGS. 5A and 5B) of the label mount part 70*a* along the tape transport direction and a length B (see FIGS. 5A and 5B) of the inter-label-mount part 70*b* along the tape transport direction. The input information for initialization may be entered based on the operation of the touch panel part 3A or the detection result of the sensor 30.

The ROM 73 stores, e.g. a control program for executing label producing processing (including a control program executing processes of a flowchart shown in FIG. 9 described later). The nonvolatile memory 77 stores medium information containing the length A of the label mount part 70*a* and the length B of the inter-label-mount part 70*b*, initially set based on the above-described input information for initialization. The nonvolatile memory 77 further stores a correction value (details will be described later) for correcting the transport stop position of the print-receiving tape 7.

<Transport Mode of Print-Receiving Tape>

In the label producing device 1 configured as above, two different transport modes, i.e. the normal transport mode and the separation transport mode are selectively implemented as the transport mode of the print-receiving tape 7.

<Normal Transport Mode>

In the case of transporting the print-receiving tape 7 in the normal transport mode, when the operator stores and sets the roll TR in the roll storage part 9, the operator manually pulls out the print-receiving tape 7 from the stored roll TR, to deliver the print-receiving tape 7 to the position of the first discharging exit 6A without separating the print-receiving portion 7Ba by the separation plate 51. In that state, the operator closes the top cover unit 3 to complete the setting of the roll TR. After the completion of setting of the roll TR in this manner, the print-receiving tape 7 fed out from the roll TR by the rotation of the platen roller 42 is subjected to the print formation on the print-receiving portion 7Ba by the printing head 43 to consequently form a print portion 7Ba' thereon. Afterward, the print-receiving tape 7 is delivered intactly, in the state where the print label L and the separation material 7A are united together, to the first discharging exit 6A without undergoing the separation at the separation plate 51. In this case, the operator cuts the print-receiving tape 7 discharged via the first discharging exit 6A to the outside of the housing 2 at a desired position using the cutting blade 8.

<Separation Transport Mode>

In the case of transporting the print-receiving tape 7 in the separation transport mode, the operator manually pulls out the print-receiving tape 7 from the stored roll TR, to deliver the print-receiving tape 7 to the position of the first discharging exit 6A, while simultaneously folding back, through the separation plate 51, the separation material 7A peeled away and separated from the pulled-out print-receiving tape 7 downward of the platen roller 42, to deliver the separation material 7A to the position of the second discharging exit 6B. Subsequently, the operator closes the opening/closing lid 6C to allow the separation material 7A to be clamped between the pinch roller 61 disposed on the opening/closing lid 6C and the platen roller 42, and closes the top cover unit 3 to complete the setting of the roll TR. After the completion of setting of the roll TR in this manner, the print-receiving tape 7 fed out from the roll TR similarly to the above undergoes the print formation on the print-receiving portion 7Ba to form a print portion 7Ba' thereon, and then is subjected to the separation of the print labels L at the separation plate 51. The separation material 7A free from the print labels L as a result of this separation is delivered to the second discharging exit 6B, while the separated print labels L are delivered to the first discharging exit 6A.

<Transport Stop Position of Print-Receiving Tape>

Figure 7B:
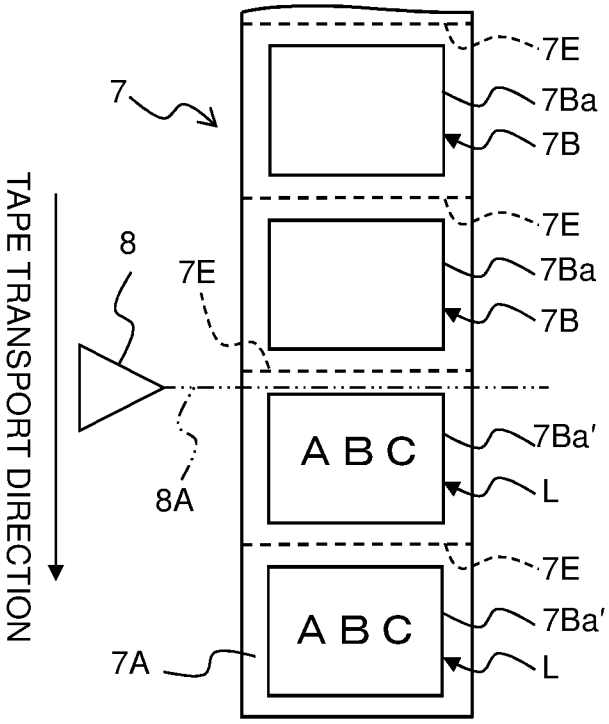
FIG. 7B is an explanatory view for explaining the transport stop position of the print-receiving tape.
Figure 7A:
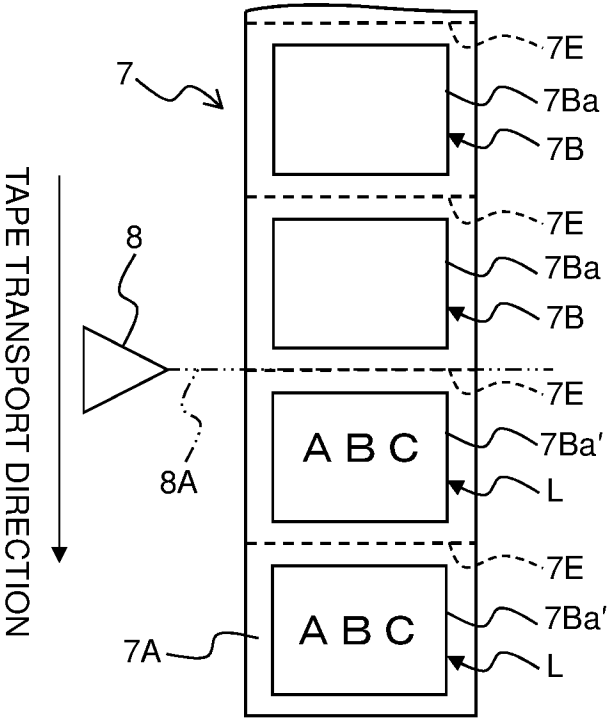
FIG. 7A is an explanatory view for explaining a transport stop position of the print-receiving tape.

In the case of transporting the print-receiving tape 7 in the normal transport mode, the transport of the print-receiving tape 7 is controlled, by control (transport stop control) of the CPU 71 based on the detection result of the sensor 30 and on the initially set medium information, so as to be stopped in a state as shown in FIG. 7A (hereinafter, referred to appropriately as "proper state") where the cutting blade 8 faces the center position 7E (equivalent to a predetermined center position; hereinafter referred to appropriately as "predetermined center position 7E") on the inter-label-mount part 70*b* between a print label L of the last order along the transport direction (the second print label L from bottom in the diagram) and the label board 7B positioned immediately after the print label L of the last order along the transport direction (the second label board 7B from top in the diagram). In the proper state, the predetermined center position 7E coincides with a cutting position 8A of the cutting blade 8 in the tape transport direction.

The label producing device 1 of this embodiment allows use of a so-called third-party roll TR other than a so-called genuine roll TR.

In the case of using the genuine roll TR, set values of initially set medium information (e.g. the length A of the label mount part 70*a* and the length B of the inter-label-mount part 70*b*) are proper, the sensor 30 can properly detect the position of the inter-label-mount part 70*b*, etc. so that by the transport stop control of the CPU 71, the transport of the print-receiving tape 7 is stopped in the above-described proper state where the predetermined center position 7E coincides with the cutting position 8A in the tape transport direction, as shown in FIG. 7A.

In the case of using the third-party roll TR, however, even though the set values of initially set medium information are proper and the transport of the print-receiving tape 7 is controlled by the above-described transport stop control of the CPU 71 so as to stop in the above-described proper state, the sensor 30 may erroneously detect the position of the inter-label-mount part 70*b*, etc. due to the difference in thickness, material, surface treatment, etc. (difference in transmittance) of the print-receiving tape 7 from the genuine roll TR. For example, as shown in FIG. 7B, the predetermined center position 7E may be offset from the cutting position 8A to the upstream side or the downstream side along the tape transport direction, with the result that the transport of the print-receiving tape 7 may not be stopped in the above-described proper state (offset to the upstream side along the tape transport direction in the diagram). The amount of offset of the predetermined center position 7E from the cutting position 8A differs depending on the type of the third party.

<Feature of this Embodiment>

A feature of this embodiment lies in that if the transport of the print-receiving tape 7 is not stopped in the proper state as described above, the operator can easily and intuitively correct the transport stop position of the print-receiving tape 7 on the spot. The details thereof will be described hereinbelow.

In this embodiment, if the transport of the print-receiving tape 7 is not stopped in the above-described proper state after the transport stop of the print-receiving tape 7 by the above-described transport stop control of the CPU 71, an instruction operation for correcting the transport stop position of the print-receiving tape 7 is performed by way of the up button 4D and the down button 4E.

The up button 4D has a ▲ mark as a first graphic notation part, the vertex side (top side) of the ▲ mark of the up button 4D denoting the upstream side along the tape transport direction (the rear side of the label producing device 1; hereinafter referred to simply as "upstream side") (see FIG. 1). By way of this up button 4D, an instruction operation is performed for transporting the print-receiving tape 7 toward the upstream side (vertex side of the ▲ mark) by a first unit transport amount (the transport amount of the print-receiving tape 7 transported in response to a single operation of the up button 4D).

The down button 4E has a ▼ mark as a second graphic notation part, the vertex side (bottom side) of the ▼ mark of the down button 4E denoting the downstream side along the tape transport direction (the front side of the label producing device 1; hereinafter referred to simply as "downstream side") (see FIG. 1). By way of this down button 4E, an instruction operation is performed for transporting the print-receiving tape 7 toward the downstream side (vertex side of the ▼ mark) by a second unit transport amount (the transport amount of the print-receiving tape 7 transported in response to a single operation of the down button 4E).

The notations by the buttons 4D and 4E are not limited to the ▲ mark and ▼ mark as long as they are of shapes denoting the upstream side in the transport direction and the downstream side in the transport direction. For example, notations of other forms such as arrow marks or letters are available.

Figures 8A, 8B, 8C:
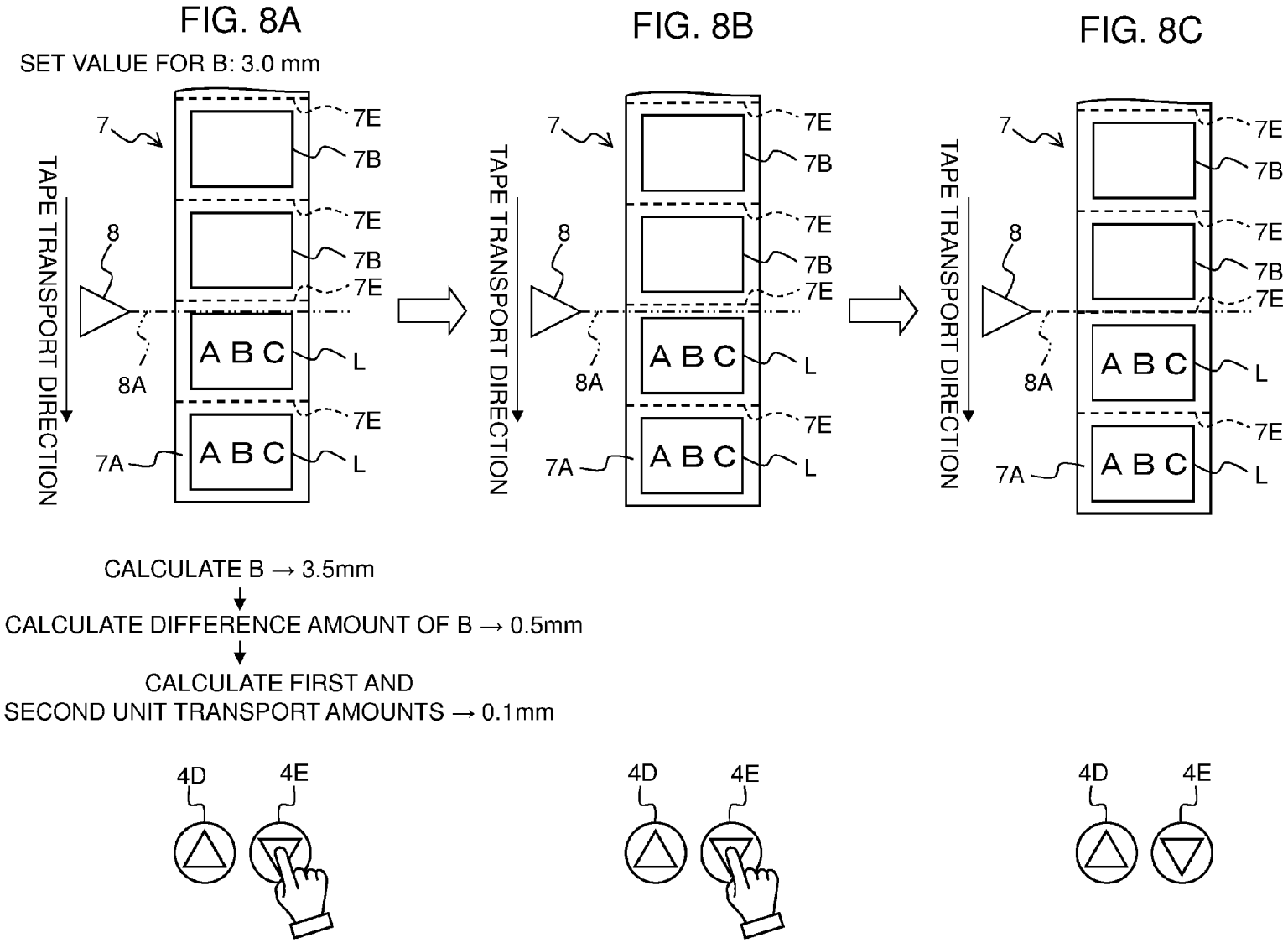
FIG. 8A is an explanatory view for explaining an example of correction of the transport stop position of the print-receiving tape.
FIG. 8B is an explanatory view for explaining an example of correction of the transport stop position of the print-receiving tape.
FIG. 8C is an explanatory view for explaining an example of correction of the transport stop position of the print-receiving tape.

FIG. 8A shows an example of the case where the transport of the print-receiving tape 7 is not stopped in the proper state. Assume as shown in FIG. 8A that with the initialized set value of the length B of the inter-label-mount part 70*b* being 3.0 [mm] in this example, the transport of the print-receiving tape 7 is stopped in a state where the predetermined center position 7E is offset toward the upstream side from the cutting position 8A.

In such a case, the length B of the inter-label-mount part 70*b* is calculated based on the number of steps of the above-described transport motor 44 in the form of a stepping motor, corresponding to the inter-label-mount part 70*b* detected by the sensor 30 at the time of the most recent print formation by the printing head 43. Assume that the length B of the inter-label-mount part 70*b* is calculated as 3.5 [mm] in this example. The amount of difference between the calculation value of the calculated length B of the inter-label-mount part 70*b* and the set value of the length B of the above-described inter-label-mount part (in other words, the detection error amount of the sensor 30) is then calculated. In this example, the calculation value of the length B of the inter-label-mount part 70*b* is 3.5 [mm] and the set value of the length B of the inter-label-mount part 70*b* is 3.0 [mm], so that the amount of difference therebetween is calculated as 0.5 [mm].

Subsequently, based on the calculated amount of difference, a first unit transport amount by the instruction operation via the above-described up button 4D and a second unit transport amount by the instruction operation via the above-described down button 4E are variably determined. That is, in the case that the above-described amount of difference is large, the transport stop position of the print-receiving tape 7 is offset from the proper state position to a great extent. Thus, since there is a high probability that the predetermined center position 7E may be largely offset from the cutting position 8A, the first and the second unit transport amounts are set to large values. On the other hand, in the case that the above-described amount of difference is small, there is a high probability that the transport stop position of the print-receiving tape 7 may not be largely offset from the proper state position, i.e. that the predetermined center position 7E may not be largely offset from the cutting position 8A, whereupon the first and the second unit transport amounts are set to small values. Assume in this example that the first and the second unit transport amounts are each determined to be 0.1 [mm] equal to ⅕ of the above-described amount of difference (=0.5 [mm]).

Thus, if the operator operates the up button 4D once, the print-receiving tape 7 is transported toward the upstream side by the above-described determined first unit transport amount (0.1 [mm] in this example). If the operator operates the down button 4E once, the print-receiving tape 7 is transported toward the downstream side by the above-described determined second unit transport amount (0.1 [mm] in this example). As long as the button 4D, 4E is operated, the transport motor 44 is turned on at a low speed allowing self-activation (not needing through up-and-down). In this embodiment, the operation of the button 4D, 4E is accepted only until a predetermined time (e.g. 5 sec.) has elapsed after the stop of transport of the print-receiving tape 7 by the above-described transport stop control of the CPU 71 (if the operation of the up button 4D or the down button 4E is accepted before the elapse of the predetermined time, the operation of the button 4D, 4E is accepted only until a predetermined time has elapsed after the acceptance of that operation).

As long as the operation of the buttons 4D, 4E is accepted, the acceptance of the normal operations (for example, feed operation, etc.) remains stopped and, after the termination of the acceptance of the operation of the button 4D, 4E, the acceptance of the normal operations is restored.

In the example shown in FIG. 8A, as described above, the transport of the print-receiving tape 7 is stopped in a state where the predetermined center position 7E is offset toward the upstream side from the cutting position 8A. Accordingly, the operator operates the down button 4E to transport the print-receiving tape 7 toward the downstream side by 0.1 [mm] (if too much transported downward, the up button 4D may be operated to transport the print-receiving tape 7 upstream by 0.1 [mm]) so that the correction can be made such that the transport stop position of the print-receiving tape 7 is shifted from the position of FIG. 8A to the position of FIG. 8B and then to the position where the predetermined center position 7E coincides with the cutting position 8A in the tape transport direction as shown in FIG. 8C.

When the correction of the transport stop position of the print-receiving tape 7 is terminated (the operation of the up button 4D or the down button 4E is not performed over a predetermined time), the result of transport of the print-receiving tape 7 based on the operation of the button 4D, 4E is stored as the above-described correction value in the nonvolatile memory 77. From this, allowing for the result of the above-described manual correction, the transport of the print-receiving tape 7 is controlled to be stopped in the above-described proper state by the transport stop control of the CPU based on the result of detection of the sensor 30, initialized medium information, and correction values stored in the nonvolatile memory 77.

<Control Procedure>

Figure 9:
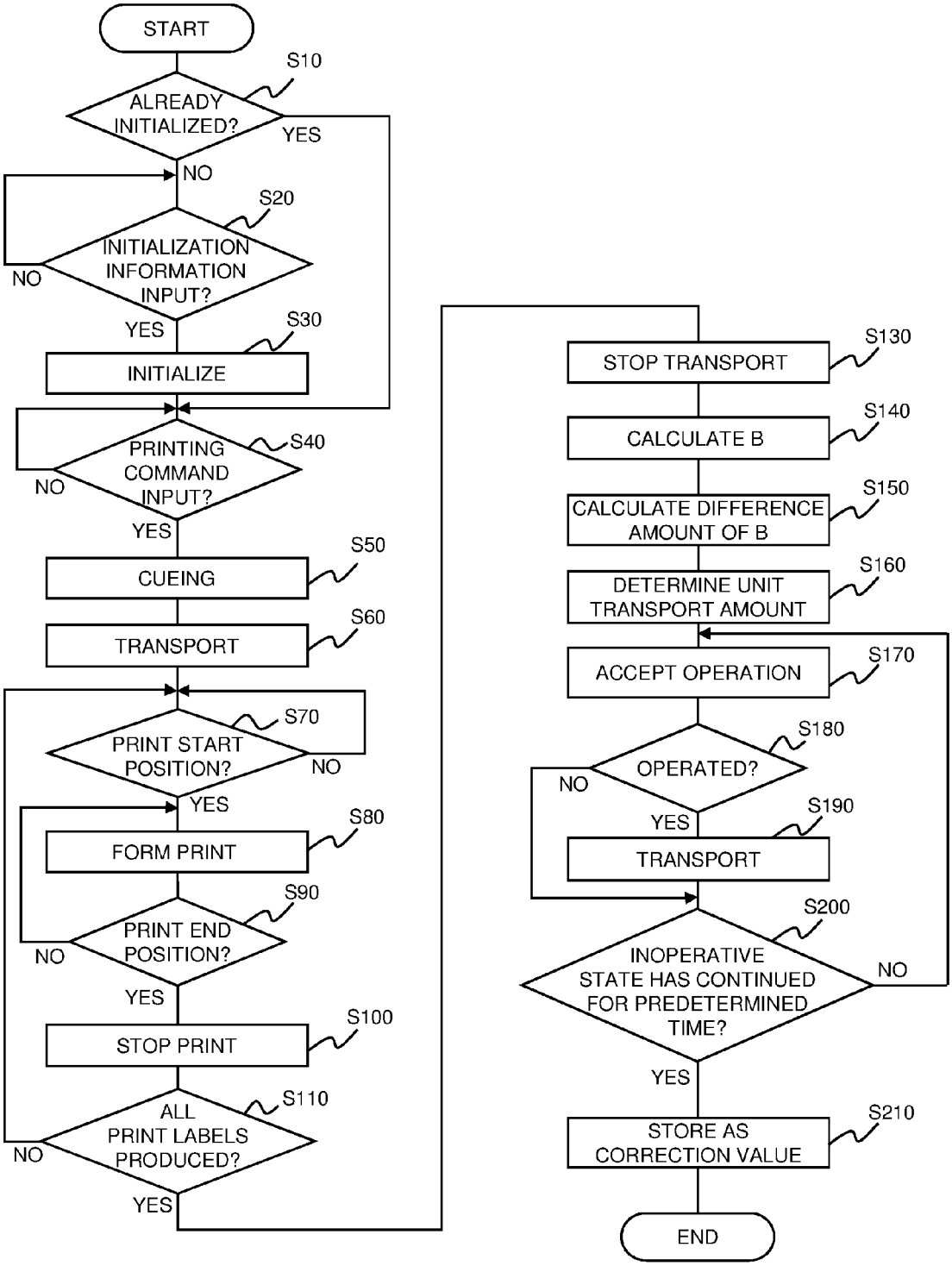
FIG. 9 is a flowchart showing control procedures executed by a CPU of the label producing device.

Referring next to FIG. 9, a control procedure executed by the CPU 71 to implement the above-described contents will be described.

In FIG. 9, the processing in this flowchart is started e.g. when the label producing device 1 is powered on.

First, at step S10, the CPU 71 determines whether the medium information is already set. If the medium information is not set, the determination of step S10 is negative (S10:NO), and the CPU 71 goes to step S20.

At step S20, the CPU 71 determines whether the input information for initial setting is input from the external terminal 76. Until the input information for initial setting is input, the determination of step S20 is negative (S20:NO) and the CPU 71 waits in a loop and, when the input information for initial setting is input, the determination of step S20 becomes affirmative (S20:YES) and the CPU 71 goes to step S30. The entered input information for initial setting is stored in the RAM 72.

At step S30, the CPU 71 sets the medium information based on the input information for initial setting input at step S20. The set medium information is stored in the nonvolatile memory 77. It is noted that step S30 corresponds to a setting process described in claims. Subsequently, the CPU 71 goes to step S40.

On the other hand, if the medium information is already set at step S10, the determination of step S10 is affirmative (S10:YES) and the CPU 71 goes to step S40.

At step S40, the CPU 71 determines whether the print command is input from the external terminal 76. Until the print command is input, the determination of step S40 is negative (S40:NO) and the CPU 71 waits in a loop and, when the print command is input, the determination of step S20 becomes affirmative (S40:YES) and the CPU 71 goes to step S50. The input print command is stored in the RAM 72.

At step S50, the CPU 71 executes a leading-end searching process for the print-receiving tape 7 based on a result of detection of the end position of the label mount 7B by the sensor 30 etc.

Subsequently, at step S60, the CPU 71 outputs a control signal to the motor drive circuit 74 to drive the transport motor 44. As a result, the platen roller 42 is driven to start the transport of the print-receiving tape 7.

At step S70, the CPU 71 determines whether the print-receiving tape 7 arrives at a start position of printing by the printing head 43 (in other words, whether the print-receiving tape 7 is transported until the printing head 43 directly faces a position corresponding to a leading end position in the tape transport direction of the print area of the print-receiving part 7B a of the label mount 7B), with a known technique. Until the tape arrives at the start position of printing, the determination of step S70 is negative (S70:NO) and the CPU 71 waits in a loop and, when the tape arrives at the start position of printing, the determination of step S70 becomes affirmative (S70:YES) and the CPU 71 goes to step S80.

At step S80, the CPU 71 outputs a control signal to the printing head control circuit 75 to control energization of the heat generation element of the printing head 43 based on the print data of the print command input at step S40. As a result, print formation is started in accordance with the print data on the print-receiving part 7B a of the label mount 7B.

Subsequently, at step S90, the CPU 71 determines whether the position in the tape transport direction of the print-receiving tape 7 arrives at a print end position based on the print data of the print command input at step S40, with a known technique. Until the position arrives at the print end position, the determination of step S90 is negative (S90:NO) and the CPU 71 returns to step S80 to repeat the same procedure. When the position arrives at the print end position, the determination of step S90 becomes affirmative (S90:YES) and the CPU 71 goes to step S100.

At step S100, the CPU 71 outputs a control signal to the printing head control circuit 75 to stop the energization of the heat generation element of the printing head 43. As a result, the printing onto the print-receiving part 7Ba of the label mount 7B is stopped.

Subsequently, at step S110, the CPU 71 determines whether the production of all the print labels L is completed in accordance with the production number of the print labels L of the print command input at step S40. If the production of all the print labels L is not completed, the determination of step S110 is negative (S110:NO) and the CPU 71 returns to step S70 to repeat the same procedure. If the production of all the print labels L is completed, the determination of step S110 is affirmative (S110:YES) and the CPU 71 goes to step S130.

At step S130, the CPU 71 outputs a control signal to the motor drive circuit 74 and attempts to stop the transport of the print-receiving tape 7 at a position achieving the proper state based on the detection result of the sensor 30 and the setting result of step S30 (if the correction value is stored in the nonvolatile memory 77, also based on the correction value). It is noted that step S130 corresponds to a transport stop process described in claims.

Subsequently, at step S140, the CPU 71 calculates the length B of the inter-label-mount part 70*b* based on the number of steps of the transport motor 44 corresponding to the inter-label-mount part 70*b* detected by the sensor 30 at the time of the last print formation by the printing head 43. It is noted that step S140 corresponds to a calculation process described in claims.

At step S150, the CPU 71 calculates a difference amount from the calculation value of the length B of the inter-label-mount part 70*b* calculated at step S140 and the setting value of the length B of the inter-label-mount part 70*b* set at step S30.

Subsequently, at step S160, the CPU 71 variably determines the first and second unit transport amounts in accordance with the difference amount calculated at step S150. It is noted that step S160 corresponds to a determination process described in claims.

At step S170, the CPU 71 accepts the operation of the buttons 4D, 4E. When accepting the operation of the buttons 4D, 4E, the CPU 71 may display on the liquid crystal panel part 3B that the transport stop position of the print-receiving tape 7 can be corrected based on the operation of the buttons 4D, 4E.

Subsequently, at step S180, the CPU 71 determines whether the operation of the up button 4D or the down button 4E is accepted at step S170. If the operation of the up button 4D or the down button 4E is accepted, the determination of step S180 is affirmative (S180:YES) and the CPU 71 goes to step S190.

At step S190, the CPU 71 outputs a control signal to the motor drive circuit 74 in accordance with the operation of the up button 4D or the down button 4E accepted at step S170 to drive the platen roller 42 to transport the print-receiving tape 7 to the upstream side by the first unit transport amount determined at step S160 (if the operation of the up button 4D is accepted) or to transport the print-receiving tape 7 to the downstream side by the second unit transport amount determined at step S160 (if the operation of the down button 4E is accepted). It is noted that step S190 corresponds to a first transport control process described in claims. Subsequently, the CPU 71 goes to step S200.

On the other hand, if the operation of the up button 4D or the down button 4E is not accepted at step S180, the determination of step S180 is negative (S180:NO) and the CPU 71 goes to step S200.

At step S200, the CPU 71 determines whether the period without accepting the operation of the up button 4D or the down button 4E is continued for a predetermined time. If the period without accepting the operation of the up button 4D or the down button 4E is not continued for a predetermined time, the determination of step S200 is negative (S200:NO) and the CPU 71 returns to step S170 to repeat the same procedure. If the period without accepting the operation of the up button 4D or the down button 4E is continued for a predetermined time, the determination of step S200 is affirmative (S200:YES) and the CPU 71 goes to step S210. As a result, the acceptance of the operation of the up button 4D or the down button 4E is terminated. It is noted that steps S170 and S200 correspond to an operation acceptance process described in claims.

At step S210, the CPU 71 stores as the correction value into the nonvolatile memory 77 a result of transport of the print-receiving tape 7 at step S190 based on the operation of the up button 4D or the down button 4E accepted at step S170. As a result, the process of this flowchart is terminated. The process of this flowchart is repeatedly executed. Therefore, after step S210 is executed, the correction value is stored in the nonvolatile memory 77 and, therefore, the correction value is used at step S130.

Although the above example has been described by using the case of setting the first and second unit transport amounts to the same value, this is not a limitation, and the first and second unit transport amounts may be set to different values. In this case, for example, if the transport stop position of the print-receiving tape 7 is deviated to the upstream side (e.g., this is recognized by the CPU 71 when the button 4E is operated once), the second unit transport amount may be set to a value larger than the first unit transport amount and, if the transport stop position of the print-receiving tape 7 is deviated to the downstream side (e.g., this is recognized by the CPU 71 when the button 4D is operated once), the first unit transport amount may be set to a value larger than the second unit transport amount. As the correction of the transport stop position of the print-receiving tape 7 proceeds based on the operation of the buttons 4D, 4E, the value of the first and second unit transport amounts may be made smaller and, in this case, the correction can more accurately be made. The first and second unit transport amounts may be set to a predefined value (fixed value).

If a deviation amount is large when the transport of the print-receiving tape 7 is stopped, a notification of the large deviation amount may be made by using the liquid crystal panel part 3B, a LED not shown, etc. In particular, for example, if the number of times of operation of the buttons 4D, 4E is larger than a predetermined threshold value, a notification of "the large deviation amount" is made at the next time of label formation.

The present disclosure is not limited to the embodiment and may variously be modified without departing from the spirit and the technical ideas thereof. Such modification examples will hereinafter be described.

(1) When Correction Operation is Performed on Operation Terminal

Although the embodiment has been described by taking as an example the case of performing the correction operation of the transport stop position of the print-receiving tape 7 through the buttons 4D, 4E of the label producing device 1, this is not a limitation. For example, the correction operation of the transport stop position of the print-receiving tape 7 may be performed on an operation terminal capable of intercommunication with the label producing device 1.

A system configuration of a label producing system of this modification example will hereinafter be described with reference to FIG. 10.

Figure 10:
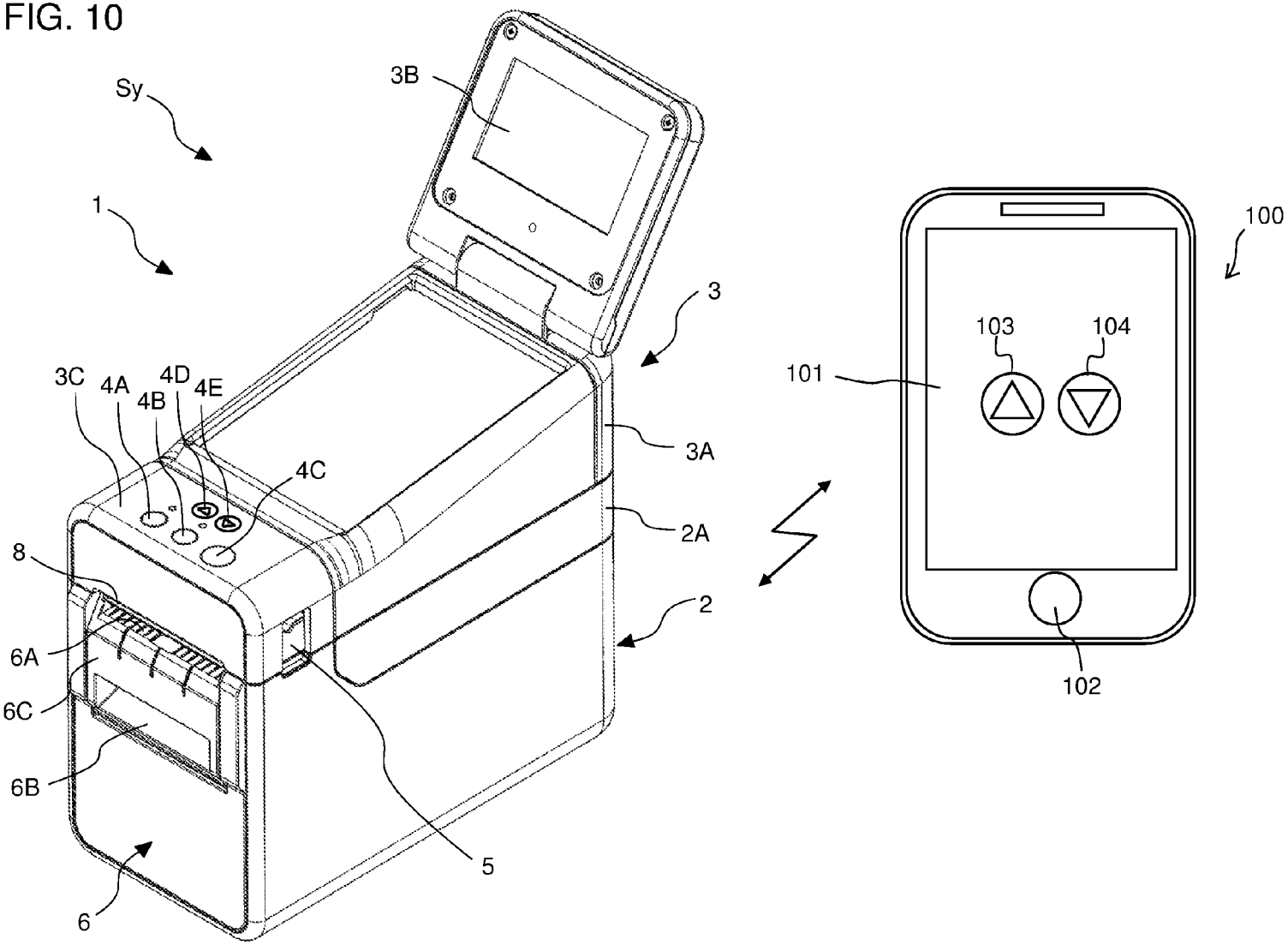
FIG. 10 is a system configuration view of a label producing system of a modification example in which a correction operation is performed on the operation terminal.

As shown in FIG. 10, a label producing system Sy (corresponding to a printing system) has the label producing device 1 having the same configuration as the embodiment and an operation terminal 100 made up of, for example, a smartphone capable of intercommunication with the label producing device 1 through short-range wireless communication, for example.

In this modification example, the CPU 71 of the label producing device 1 is connected to a communication control part (not shown) controlling the communication with the operation terminal 100, and a control program for executing procedures of a flowchart shown in FIG. 11 described later is stored in the ROM 73. In this modification example, the up button 4D and the down button 4E of the label producing device 1 may not be included.

The operation terminal 100 includes an operation button 102 that can be operated by an operator, and a touch panel part 101. The operation terminal 100 also includes a CPU making up a calculation part performing a predetermined calculation, a RAM, a ROM, a nonvolatile memory, and a communication control part controlling communication with the label producing device 1 (not shown). A control program for executing procedures of a flowchart shown in FIG. 12 described later is stored in the ROM or the nonvolatile memory.

In this modification example, after the transport of the print-receiving tape 7 is stopped by the transport stop control of the CPU 71 of the label producing device 1, a correction request command signal is transmitted from the label producing device 1 to the operation terminal 100 so as to correct the transport stop position of the print-receiving tape 7. When the correction request command signal is received by the operation terminal 100, the touch panel part 101 displays an up button 103 (corresponding to a third operation device) having, for example, a triangle mark indicated thereon, and a down button 104 (corresponding to a fourth operation device) having, for example, an inverted triangle mark indicated thereon, and a transmission operation to the label producing device 1 is performed through these buttons 103, 104 for a transport command signal for correcting the transport stop position of the print-receiving tape 7.

In particular, the transmission operation to the label producing device 1 is performed through the up button 103 for a first transport command signal for transporting the print-receiving tape 7 to the upstream side by a first unit transport amount (a transport amount of the print-receiving tape 7 transported in accordance with one operation of the up button 103). The transmission operation to the label producing device 1 is performed through the down button 104 for a second transport command signal for transporting the print-receiving tape 7 to the downstream side by a second unit transport amount (a transport amount of the print-receiving tape 7 transported in accordance with one operation of the down button 104).

Control procedures executed by the CPU 71 of the label producing device 1 in this modification example will hereinafter be described with reference to FIG. 11. FIG. 11 corresponds to FIG. 9. Control procedures executed by the CPU of the operation terminal 100 will be described with reference to FIG. 12.

Figure 11:
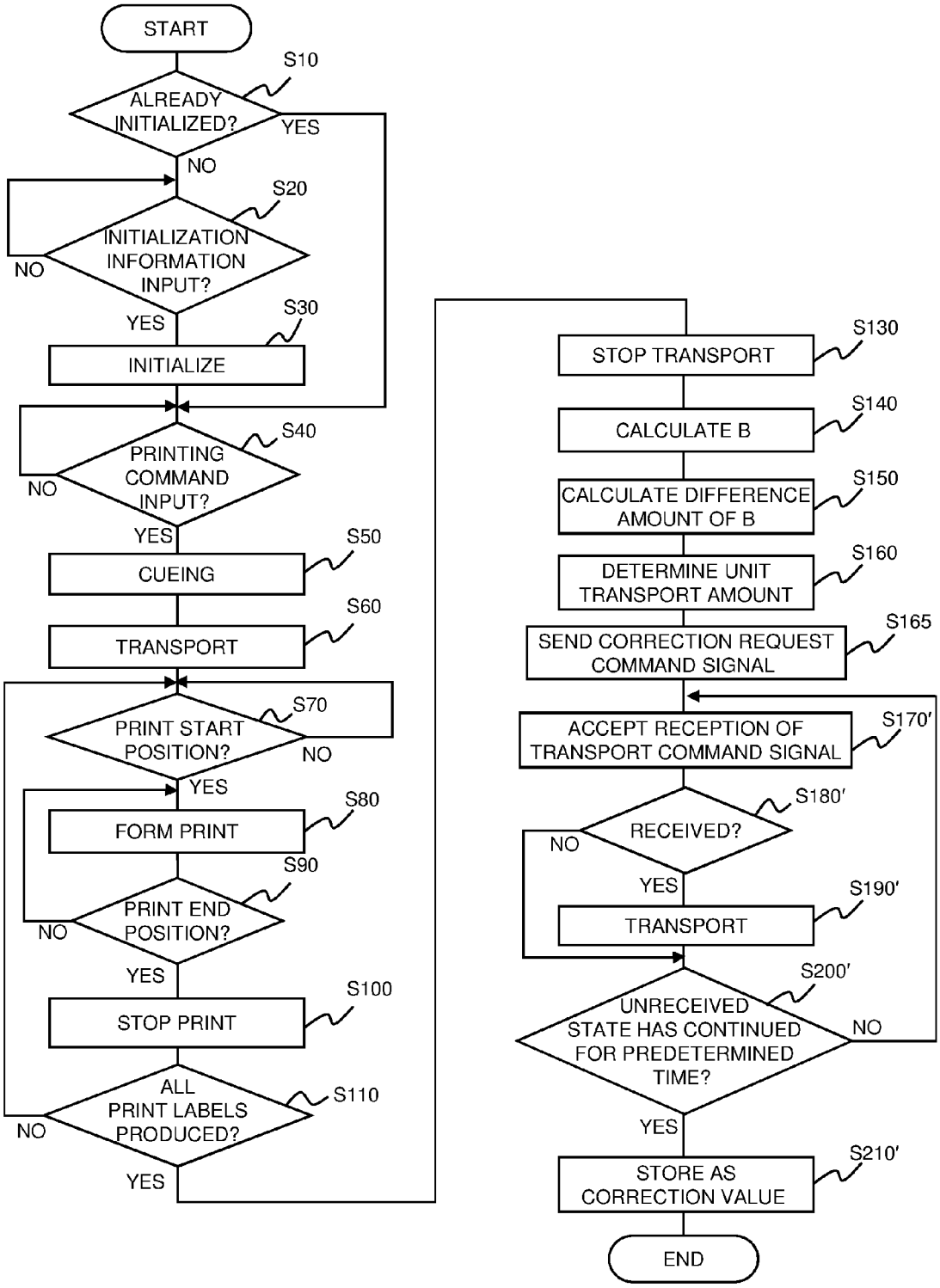
FIG. 11 is a flowchart showing control procedures executed by the CPU of the label producing device.

In FIG. 11, steps S165, S170', S180', S190, S200', and S210' are different from FIG. 9. Therefore, steps S10 to S160 are the same as those of FIG. 9 and, after variably determining the first and second unit transport amounts at step S160, the CPU 71 goes to step S165.

At step S165, the CPU 71 transmits the correction request command signal through the communication control part to the operation terminal 100 so as to request correction of the transport stop position of the print-receiving tape 7. It is noted that step S165 corresponds to a first transmission process described in claims. Subsequently, the CPU 71 goes to step S170' described later.

Figure 12:
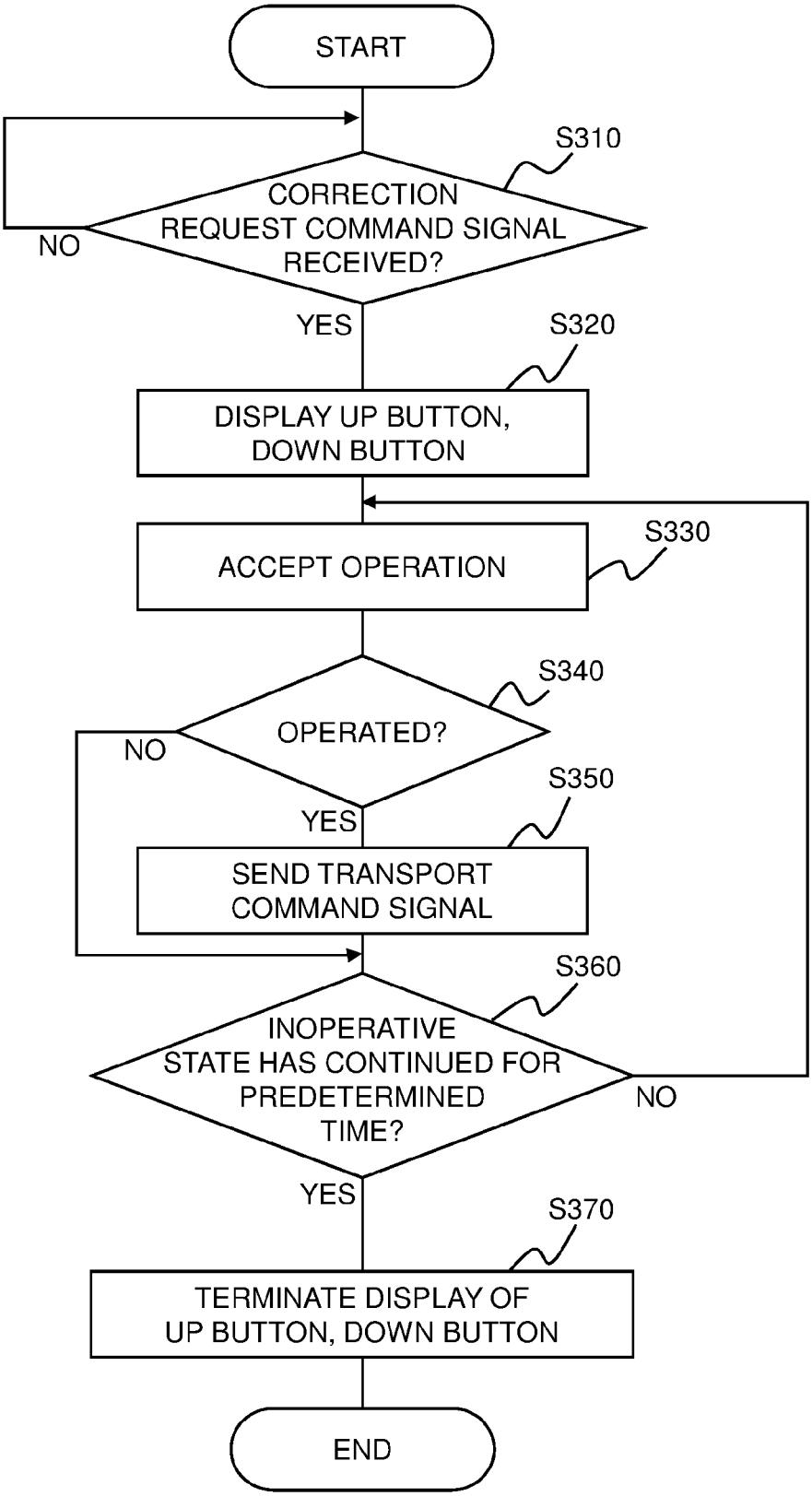
FIG. 12 is a flowchart showing control procedures executed by a CPU of the operation terminal.

On the other hand, in FIG. 12, the process of this flowchart is started when an application is started in accordance with the predetermined control program stored in the ROM or the nonvolatile memory of the operation terminal 100, for example.

First, at step S310, the CPU determines whether the correction request command signal transmitted from the label producing device 1 at step S165 is received through the communication control part. Until the correction request command signal is received, the determination of step S310 is negative (S310:NO) and the CPU waits in a loop and, if the correction request command signal is received, the determination of step S310 becomes affirmative (S310:YES) and the CPU goes to step S320. It is noted that step S310 corresponds to a first reception process described in claims.

At step S320, the CPU outputs a display signal to the touch panel part 101 to display the buttons 103, 104 in a predetermined area.

Subsequently, at step S330, the CPU accepts the operation of the buttons 103, 104. When accepting the operation of the buttons 103, 104, the CPU 71 may display on another area of the touch panel part 101 that the transport stop position of the print-receiving tape 7 can be corrected based on the operation of the buttons 103, 104.

At step S340, the CPU determines whether the operation of the up button 103 or the down button 104 is accepted at step S330. If the operation of the up button 103 or the down button 104 is accepted, the determination of step S340 is affirmative (S340:YES) and the CPU goes to step S350.

At step S350, in accordance with the operation of the up button 103 or the down button 104 accepted at step S330, the CPU outputs a first transport command signal for transporting the print-receiving tape 7 to the upstream side by the first unit transport amount determined at step S160, through the communication control part to the label producing device 1 (if the operation of the up button 103 is accepted), or outputs a second transport command signal for transporting the print-receiving tape 7 to the downstream side by the second unit transport amount determined at step S160, through the communication control part to the label producing device 1 (if the operation of the down button 104 is accepted). It is noted that step S350 corresponds to a second transmission process described in claims. Subsequently, the CPU goes to step S360.

If the operation of the up button 103 or the down button 104 is not accepted at step S340, the determination of step S340 is negative (S340:NO) and the CPU goes to step S360.

At step S360, the CPU determines whether the period without accepting the operation of the up button 103 or the down button 104 is continued for a predetermined time. If the period without accepting the operation of the up button 103 or the down button 104 is not continued for a predetermined time, the determination of step S360 is negative (S360:NO) and the CPU returns to step S330 to repeat the same procedure. If the period without accepting the operation of the up button 103 or the down button 104 is continued for a predetermined time, the determination of step S360 is affirmative (S360:YES) and the CPU goes to step S370. As a result, the acceptance of the operation of the up button 103 or the down button 104 is terminated.

At step S370, the CPU outputs a display signal to the touch panel part 101 to terminate the display of the buttons 103, 104. As a result, the process of this flowchart is terminated. The process of this flowchart is repeatedly executed.

On the other hand, in FIG. 11, at step S170', the CPU 71 receives through the communication control part the first transport command signal or the second transport command signal transmitted from the operation terminal 100 at step S350. It is noted that step S170' corresponds to a second reception process described in claims.

At step S180', the CPU 71 determines whether the first transport command signal or the second transport command signal is received at step S170'. If the first transport command signal or the second transport command signal is received, the determination of step S180' is affirmative (S180':YES) and the CPU 71 goes to step S190'.

At step S190', the CPU 71 outputs a control signal to the motor drive circuit 74 in accordance with the first transport command signal or the second transport command signal received at step S170' to drive the platen roller 42 to transport the print-receiving tape 7 to the upstream side by the first unit transport amount determined at step S160 (if the first transport command signal is received) or to transport the print-receiving tape 7 to the downstream side by the second unit transport amount determined at step S160 (if the second transport command signal is received). It is noted that step S190' corresponds to a second transport control process described in claims. Subsequently, the CPU 71 goes to step S200'.

On the other hand, if the first transport command signal or the second transport command signal is not received at step S180', the determination of step S180' is negative (S180': NO) and the CPU 71 goes to step S200'.

At step S200', the CPU 71 determines whether the period without receiving the first transport command signal or the second transport command signal is continued for a predetermined time. If the period without receiving the first transport command signal or the second transport command signal is not continued for a predetermined time, the determination of step S200' is negative (S200':NO) and the CPU 71 returns to step S170' to repeat the same procedure. If the period without receiving the first transport command signal or the second transport command signal is continued for a predetermined time, the determination of step S200' is affirmative (S200':YES) and the CPU 71 goes to step S210'. As a result, the acceptance of the reception of the first transport command signal or the second transport command signal is terminated.

At step S210', the CPU 71 stores as the correction value into the nonvolatile memory 77 a result of transport of the print-receiving tape 7 at step S190' based on the first transport command signal or the second transport command signal received at step S170. As a result, the process of this flowchart is terminated. The process of this flowchart is repeatedly executed. Therefore, after step S210' is executed, the correction value is stored in the nonvolatile memory 77 and, therefore, the correction value is used at step S130.

(2) Others

Although the sensor 30 is made up of a transmission type optical sensor in the above description, this is not a limitation, and the sensor (detecting device) may be made up of a reflection type optical sensor. Alternatively, a transmission type optical sensor and a reflection type optical sensor may be used together.

Although the inter-label-mount part 70*b* of the print-receiving tape 7 is detected by the sensor 30 as the element to be detected in the above description, this is not a limitation, and black marks may be disposed on the print-receiving tape 7 at predetermined pitches to detect these black marks by the sensor 30 as the element to be detected.

Although the description has been made of the case of using the print-receiving tape 7 having the label mounts 7B arranged sequentially at constant intervals (so-called die-cut labels), this is not a limitation, and a print-receiving tape is also usable that includes a thermal layer or an image receiving layer on an entire surface with black marks disposed on constant intervals (so-called medium with marks).

It is noted that terms "vertical," "parallel," "plane," etc. in the above description are not used in the exact meanings thereof. Specifically, these terms "vertical," "parallel," and "plane" allow tolerances and errors in design and manufacturing and have meanings of "substantially vertical," "substantially parallel," and "substantially plane."

It is noted that terms "same," "equal," "different," etc. in relation to dimension and size of the exterior appearance in the above description are not used in the exact meaning thereof. Specifically, these terms "same," "equal," and "different" allow tolerances and errors in design and manufacturing and have meanings of "substantially the same," "substantially equal," and "substantially different." However, in the case of a value used as a predefined determination criterion or a delimiting value such as a threshold value and a reference value, the terms "same," "equal," "different, " etc. used for such values are different from the above definition and have the exact meanings.

The arrows shown in FIG. 6 indicate an example of signal flow and are not intended to limit the signal flow directions.

The flowcharts shown in FIGS. 9, 11, and 12 are not intended to limit the present disclosure to the shown procedures and the procedures may be added/deleted or may be executed in different order without departing from the spirit and the technical ideas of the disclosure.

The techniques of the embodiment and the modification examples may appropriately be utilized in combination other than those described above.

Although not exemplarily illustrated one by one, the present disclosure is implemented with other various modifications without departing from the spirit thereof.

What is claimed is:

1. A printer comprising:

a roll storage part configured to store a print-receiving medium roll having a print-receiving medium wound therearound, said print-receiving medium including a plurality of print-receiving parts and an element to be detected for identifying said print-receiving parts;

a feeder configured to transport said print-receiving medium fed out from said print-receiving medium roll stored in said roll storage part;

a driving device configured to drive said feeder;

a printing head configured to sequentially form a desired print on said plurality of print-receiving parts of said print-receiving medium transported by said feeder so as to create a plurality of print parts;

a cutter that is configured to cut said print-receiving medium, and is disposed downstream of said printing head along a transport direction of said feeder;

a detecting device configured to detect said element to be detected; and a controller, said controller being configured to execute:

a setting process for setting medium information based on input information for an initial setting, said medium information including at least an arrangement form of said element to be detected on said print-receiving medium; and a transport stop process for controlling said driving device based on a detection result of said detecting device and a setting result of said setting process to stop transport of said print-receiving medium in a state in which a predetermined intermediate position faces said cutter, said predetermined intermediate position being between a print part last in order along said transport direction and said print-receiving part located immediately after said print part last in order along said transport direction;

said printer further comprising:

a first operation device configured to perform an operation of transporting said print-receiving medium upstream along said transport direction by a first unit transport amount so as to correct a transport stop position of said print-receiving medium after said transport of said print-receiving medium is stopped by control of said transport stop process; and a second operation device configured to perform an operation of transporting said print-receiving medium downstream by a second unit transport amount so as to correct the transport stop position of said print-receiving medium after said transport of said print-receiving medium is stopped by control of said transport stop process; and said controller being configured to further execute:

a first transport control process for controlling said driving device to transport said print-receiving medium upstream by said first unit transport amount in accordance with an operation of said first operation device or to transport said print-receiving medium downstream by said second unit transport amount in accordance with an operation of said second operation device.

2. The printer according to claim 1, wherein in said setting process:

said medium information, including a length of said element to be detected along said transport direction, is set, and said controller further executes a determination process for variably determining said first unit transport amount and said second unit transport amount in accordance with a difference amount of said length of said element to be detected based on said detection result by said detecting device and the length of said element to be detected set by said setting process, and in said first transport control process, said driving device is controlled to transport said print-receiving medium upstream by said first unit transport amount determined by said determination process in accordance with an operation of said first operation device, or to transport said print-receiving medium downstream by said second unit transport amount determined by said determination process in accordance with an operation of said second operation device.

3. The printer according to claim 2, wherein based on control in said first transport control process, said driving device is driven at low speed enabling self-start without requiring slew-up/slew-down while said first operation device or said second operation device is operated.

4. The printer according to claim 2, wherein said driving device is a stepping motor, said controller further executes a calculation process for calculating the length of said element to be detected based on a number of steps of said stepping motor corresponding to said element to be detected that is detected by said detecting device, and in said determination process, said first unit transport amount and said second unit transport amount are variably determined in accordance with a difference amount of the length of said element to be detected calculated by said calculation process and the length of said element to be detected set by said setting process.

5. The printer according to claim 1, wherein:

said controller further executes an operation acceptance process for accepting an operation of said first operation device and said second operation device only before a predetermined time has elapsed after transport of said print-receiving medium is stopped by control of said transport stop process, and in said first transport control process, said driving device is controlled to transport said print-receiving medium upstream by said first unit transport amount in accordance with the operation of said first operation device accepted by said operation acceptance process or to transport said print-receiving medium downstream by said second unit transport amount in accordance with the operation of said second operation device accepted by said operation acceptance process.

6. The printer according to claim 1, further comprising a memory configured to store a result of transport of said print-receiving medium controlled by said first transport control process as a correction value for correcting a transport stop position of said print-receiving medium, wherein in said transport stop process, based on a detection result of said detecting device, a setting result of said setting process, and said correction value stored in said memory, said driving device is controlled to stop said transport of said print-receiving medium by said feeder in a state in which said intermediate position faces said cutter.

7. The printer according to claim 1, wherein:

said first operation device has a first graphical indication part including a shape indicating an upstream side along the transport-direction, and said second operation device has a second graphical indication part including a shape indicating an downstream side along the transport-direction.

8. The printer according to claim 7, wherein:

said first indication part has a triangular shape with an apex upward, and said second indication part has a triangular shape with an apex downward.

9. A printing system comprising:

a printer; and an operation terminal configured to intercommunicate with said printer;

said printer including:

a roll storage part configured to store a print-receiving medium roll having a print-receiving medium wound therearound, said print-receiving medium including a plurality of print-receiving parts and an element to be detected for identifying said print-receiving parts;

a feeder configured to transport said print-receiving medium fed out from said print-receiving medium roll stored in said roll storage part;

a driving device configured to drive said feeder;

a printing head configured to sequentially form a desired print on said plurality of print-receiving parts of said print-receiving medium transported by said feeder so as to create a plurality of print parts;

a cutter that is configured to cut said print-receiving medium, and is disposed downstream of said printing head along a transport direction of said feeder;

a detecting device configured to detect said element to be detected; and a controller, said controller being configured to execute:

a setting process for setting medium information based on input information for initial setting, said medium information at least including an arrangement form of said element to be detected on said print-receiving medium, a transport stop process for controlling said driving device based on a detection result of said detecting device and a setting result of said setting process to stop transport of said print-receiving medium in a state in which a predetermined intermediate position faces said cutter, said predetermined intermediate position being between a print part last in order along said transport direction and said print-receiving part located immediately after said print part last in order along said transport direction, and a first transmission process for transmitting a correction request command signal to said operation terminal so as to correct a transport stop position of said print-receiving medium after said transport of said print-receiving medium is stopped by control of said transport stop process, said operation terminal including:

a CPU configured to execute a first reception process for receiving said correction request command signal transmitted by said first transmission process of said printer, a first operation device configured to perform operation of transporting said print-receiving medium along said transport direction upstream by a first unit transport amount so as to correct a transport stop position of said print-receiving medium after reception of said correction request command signal by said first reception process, and a second operation device configured to perform operation of transporting said print-receiving medium downstream by a second unit transport amount so as to correct the transport stop position of said print-receiving medium after the reception of said correction request command signal by said first reception process, said CPU being configured to further execute a second transmission process for transmitting to said printer a first transport command signal for transporting said print-receiving medium upstream by said first unit transport amount in accordance with the operation of said first operation device or transmitting to said printer a second transport command signal for transporting said print-receiving medium to said downstream side by said second unit transport amount in accordance with the operation of said second operation device, said controller of said printer being configured to further execute:

a second reception process for receiving said first transport command signal or said second transport command signal transmitted by said second transmission process of said operation terminal; and a second transport control process for controlling said driving device to transport said print-receiving medium upstream by said first unit transport amount in accordance with said first transport command signal received by said second reception process or to transport said print-receiving medium downstream by said second unit transport amount in accordance with said second transport command signal received by said second reception process.

* * * * *